United States Patent [19]

Zimmer et al.

[11] Patent Number: 4,848,269

[45] Date of Patent: Jul. 18, 1989

[54] DEVICE FOR DOSED APPLICATION OF FLOWABLE MEDIA ON A WEB OR CYLINDER

[75] Inventors: Johannes Zimmer, Ebentaler Str. 133, A-9020 Klagenfurt; Friedrich Letschnig, Klagenfurt, both of Austria

[73] Assignee: Johannes Zimmer, Klagenfurt, Austria

[21] Appl. No.: 51,143

[22] PCT Filed: Aug. 28, 1986

[86] PCT No.: PCT/AT86/00052

§ 371 Date: Apr. 30, 1987

§ 102(e) Date: Apr. 30, 1987

[87] PCT Pub. No.: WO87/01308

PCT Pub. Date: Mar. 12, 1987

[30] Foreign Application Priority Data

Aug. 30, 1985 [AT] Austria ..... 2546/85

[51] Int. Cl.[4] ..... B05C 1/08

[52] U.S. Cl. ..... 118/262; 118/212

[58] Field of Search ..... 101/282 MV; 118/272, 118/262, 213

[56] References Cited

U.S. PATENT DOCUMENTS

| | | | |
|---|---|---|---|
| 4,046,931 | 9/1977 | Innes et al. | 118/262 X |
| 4,378,390 | 3/1983 | Yoshida et al. | 118/262 X |
| 4,428,291 | 1/1984 | Dorow | 101/350 |

FOREIGN PATENT DOCUMENTS

| | | |
|---|---|---|
| 2437006 | 2/1976 | Fed. Rep. of Germany . |
| 3436082 | 4/1985 | Fed. Rep. of Germany . |

OTHER PUBLICATIONS

PCT, WO85/01226, Zimmer, 3/28/85.

*Primary Examiner*—Shrive Beck
*Assistant Examiner*—Alain Bashore
*Attorney, Agent, or Firm*—Herbert Dubno

[57] ABSTRACT

In order to apply a product to a support (10) a transfer cylinder (1) with a checkered surface is used with an applicator cylinder (3). The applicator cylinder (3) consists at least in part of a magnetizable material, is not mounted on an axle, rotates on the transfer cylinder (1) and can move in relation to the point of application.

19 Claims, 3 Drawing Sheets

DEVICE FOR DOSED APPLICATION OF FLOWABLE MEDIA ON A WEB OR CYLINDER

CROSS REFERENCE TO RELATED APPLICATIONS

This application is a national phase application of PCT/AT No. 86 00052 filed Aug. 28, 1986 and based, in turn, upon an Austrian application No. A 2546/85 filed Aug. 30, 1985 under the International Convention.

The invention relates to a device for the dosed application of flowable media to a web or a cylinder by means of a dip- and transfer roller and an applicator roller.

BACKGROUND OF THE INVENTION

In the application of flowable media on a substrate, particularly when very small amounts of the flowable medium are to be uniformly applied, it is known to use a roller partially dipping into a trough containing the medium, so that the turning roller entrains the medium in its motion. In order to control the thickness of the layer adhering to the surface, it is known to provide stripping wipers. It is also known to first transfer the medium to be applied by means of a dosage roller to an applicator roller, which then transfers the medium to the substrate to be treated. Furthermore, it is known to use roller wipers and other application devices magnetically pressed against the substrate, during printing as well as during coating.

Particularly when small amounts of medium are applied, the interplay between the roller dipped into the medium or receiving the medium and the applicator roller, as well as the proper magnetic pressure towards the web of material, becomes very important.

SUMMARY OF THE INVENTION

In accordance with the invention, that the applicator roller resting against the surface is magnetically pressed against the latter and has an elastic surface and can rest against a transfer roller the medium to it.

The transfer roller taking up the medium to be applied, is then wiped off or rolled against the applicator roller, for dosage or measuring purposes. This insures that per surface unit, the roller takes up constantly the same amount of the medium to be applied, independently of on the consistency of the medium to be applied, i.e. whether this has a high or low viscosity, or the nature of the medium. The recesses in the grid-like patterned transfer roller are always completely filled and thereby a precisely determined amount of the medium to be applied is transferred to the applicator roller, and thus it is possible to transfer to the substrate, e.g. the web of material, a very precisely predetermined amount of medium. In addition to being magnetically pressed, the applicator roller is not mounted on an axle. In this way one of the problems which arise with the heretofore-known rollers is avoided. When rollers of normal operational width, i.e. as rule an operational width between 1.5 and 3 m, are axially supported and provided with stub axles, one always has to take into account the possibility of a roller deflection. Due to the fact that, in accordance with the invention, the applicator roller can move with respect to the application surface and be magnetically pressed against it, a constant application pressure is insured over the entire length of the roller even to the extent of allowing free deflection at seams.

BRIEF DESCRIPTION OF THE DRAWING

The invention is more fully described with the aid of the examples shown in the accompanying drawing.

In the drawing.

SPECIFIC DESCRIPTION

Figure 1:
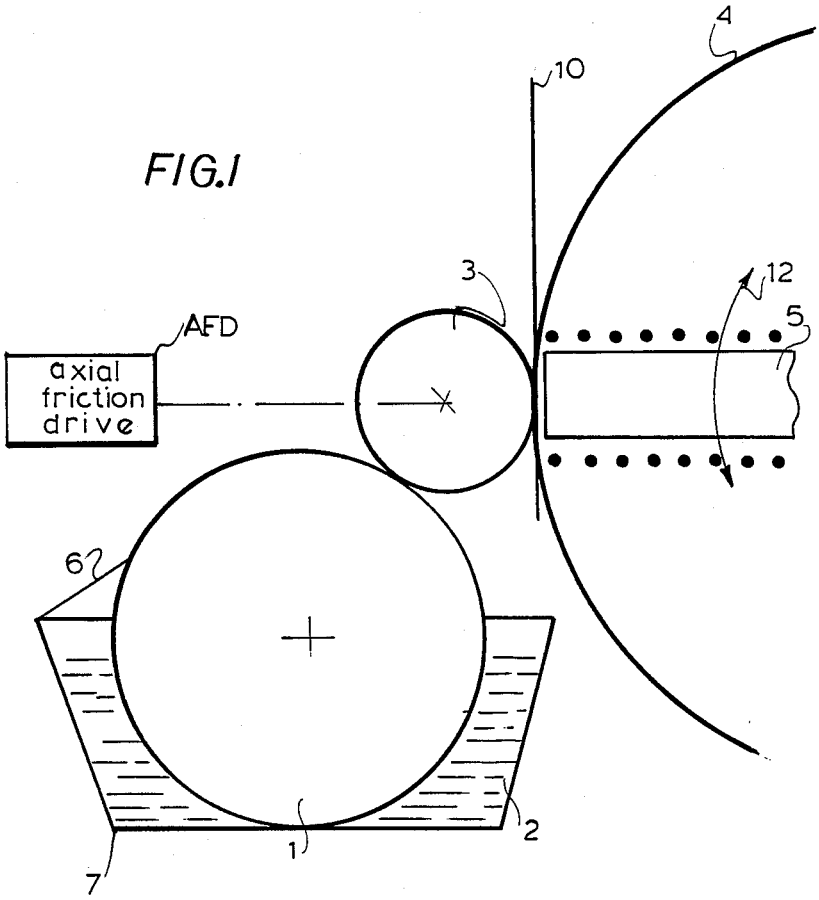
FIG. 1 is a diagrammatic section which shows an embodiment wherein a trough with the medium to be applied is provided laterally with respect to the magnetic roller.

In the embodiment according to FIG. 1, the dipper- or transfer roller 1 with a grid-like patterned surface, dips into the medium to be applied which is stored in a container 7. The medium to be applied rests in the surface recesses of the profiled surface of the roller 1 and the excess medium is wiped off by the wiper or doctor blade 6. A roller 3 rests against the transfer- and grid-like patterned roller 1, the surface of the former being preferably made of a deformable material and which can be smooth, structured or carrying a relief pattern. This applicator roller 3 receives the medium from the transfer roller 1 and carries it to the web 10. As a countersurface to the the applicator roller 3, a magnet roller 4 is provided in this case, i.e. a roller wherein electromagnets 5 are located. It is of course also possible to provide a magnet bar instead of the magnet roller 4.

The applicator roller 3, which spreads the medium to be applied onto the substrate, is mounted here without the support of an axle, and is movable with respect to the magnet roller 4, depending on the intensity of the magnetic force and the thickness of the substrate, e.g. the web 10.

It is of course possible to provide a guide for the applicator roller which takes into account this mobility.

The applicator roller 3 is located in the widening area between the transfer roller 1 and the magnet roller 4 and is in contact with the circumference of these rollers, i.e. the applicator roller 3 is only circumferentially supported. Its positioning takes place magnetically due to the electromagnets 5, possibly in conjunction with the force of gravity. In addition to the circumferential drive, an axial friction drive AFD can also be provided.

The magnet system 5 can be swingable, as indicated by the double arrow 12. The swinging of the magnet system produces a more or less stronger pressing of the applicator roller 3 against the transfer roller 1. It also has to be pointed out that for solid applications, the surface of the applicator roller 3 can be completely smooth, or when a pattern is desired, it can be equipped with a relief. The wiper 6 is preferably used only then when a pattern is to be applied to the web 10. In the case of full-surface applications, it is preferably to work without a wiper. In such cases, the magnet roller 4 is preferably substituted by a magnet bar, when the application is to take place on a surface-stable web.

Figure 2:
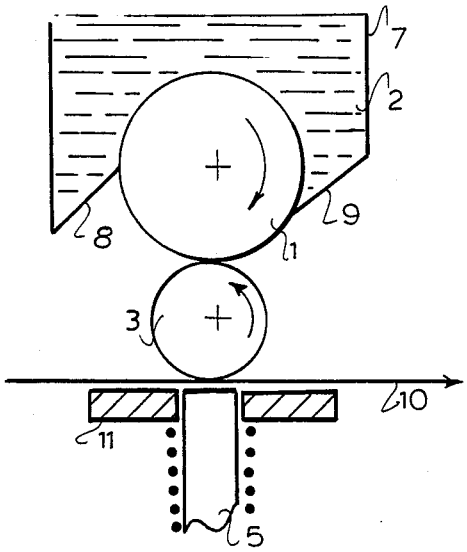
FIG. 2 is a diagrammatic section showing the grid-like patterned roller and the applicator roller arranged one over the other.

In FIG. 2, another embodiment of the invention is represented. Here, the transfer roller 1 is arranged over the applicator roller 3 and the transfer roller 1 is partially surrounded by a container 7. The container 7, in this case, is closed with respect to the transfer roller 1 by two wipers 8, 9, so that only the material taken up by the profiled pattern on the surface of the roller 1 can leave the container 7.

It can be recognized that the electromagnets are here mounted on a table 11. It is not necessary that the container 7 be closed by the two wipers 8, 9, it is also possible to provide only one wiper and to close the container on the other side of the roller 1 by different means, for instance by sealing off the roller 1 against the lateral wall of the container.

Figure 3:
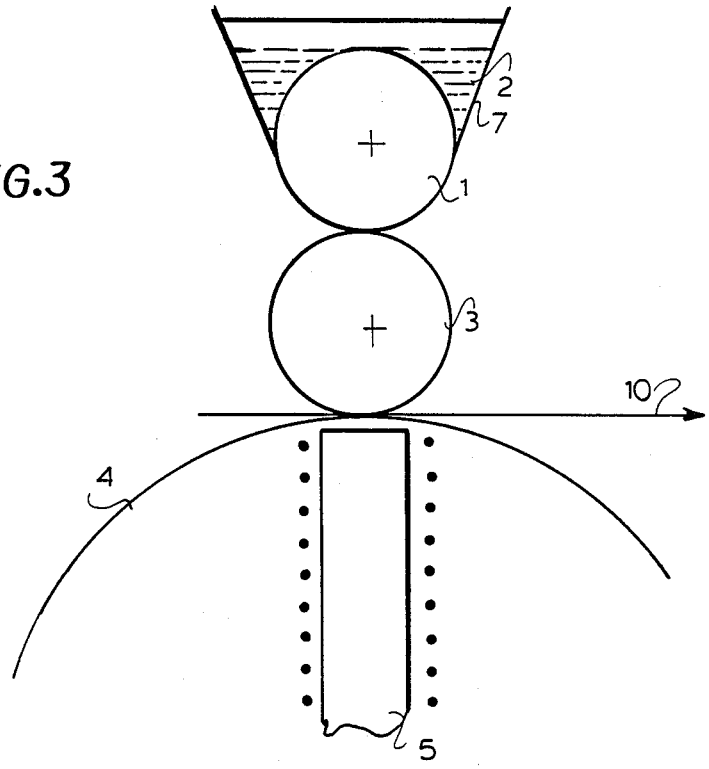
FIG. 3 is a similar view which shows an arrangement wherein the grid-like patterned roller closes an open trough.

In FIG. 3, a further embodiment of the invention is represented. The diameter of the rollers 1 and 3, which are again arranged one over the other, is here relatively small in comparison to the diameter of the magnet roller 4, and the roller 1 seals off downwardly a container 7. This container 7 can be open on top, so that the medium 2 to be applied can constantly be resupplied, for instance through a hose movable parallel to the axis of the roller 1 and ensuring a uniform distribution of the medium in the trough. The diameters of the two rollers can be so established, that then, when the two rollers are provided with a magnetizable material, the magnetic force of the electromagnets 5 acts on both rollers, so that both rollers are pressed against the web 10.

Figure 4:
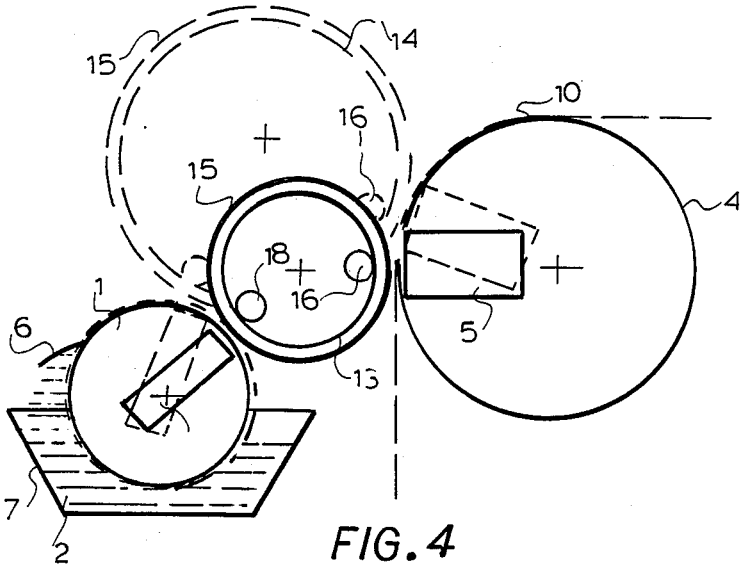

FIG. 4 shows an embodiment of the invention, wherein instead of a massive applicator roller a thin-walled bushing 13 is provided, e.g. made of glass-fiber reinforced synthetic material or metal, as for instance galvanic nickel, with a rubber coating 15. These bushings can have various diameters, and namely depending on the ratio. A bushing with a larger diameter is shown in broken lines at 14. Again, the surface of the bushing 13 or 14, can be smooth or patterned. These bushings are only circumferentially supported, and the bushing 13 or 14, can be provided with end rings, similar to the adhesive rings used in cylinder patterns. The required application pressure in the printing area results from the action of an in-laid roller 16 made of a magnetizable material, which is attracted by the magnet roller 5. As opposed to the cylinder pattern printing with magnet roller wipers, the dyeing takes place from the outside, namely over the grid-like patterned roller 1, which is also equipped with a system of magnets 17 which ensure that in the dye-transfer area a further roller 18 of magnetizable material, inserted in the bushing 13 or 14 will press the transfer roller 1 against the bushings 13 or 14.

The use of these bushings 13 or 14 is particularly advantageous in the case of larger printing widths and ratios, from the point of view of cost, handling, i.e. weight reduction. Besides, due to the use of the magnet system, the disadvantage of mechanical deflection in the case of large operational widths can be avoided.

Figure 5:
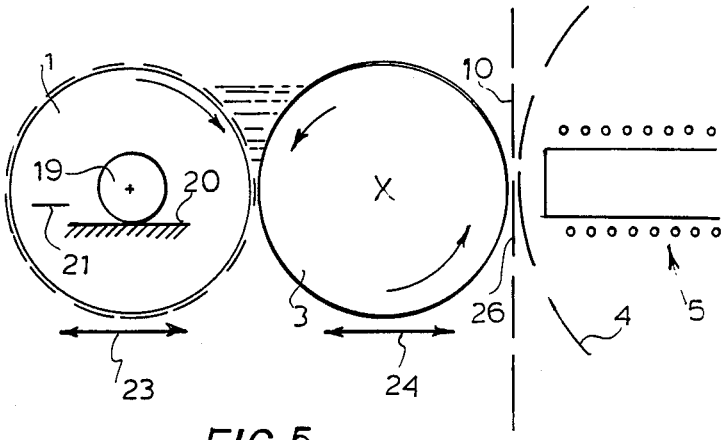
FIGS. 4, 5 and 6 are similar views which show further embodiments of the invention.

FIG. 5 shows an embodiment of the invention wherein the transfer roller 1 has a pivot 19, resting on a plane 20. The transfer roller is movable in the direction of the double arrow 23 and the applicator roller 3 is movable in the direction of the double arrow 24, i.e. both rollers can move to the application point 26, respectively can lift off therefrom. An elastic force 21 presses the roller 1 against the roller 3 and the latter against the web 10 and the magnet roller 4.

Figure 6:
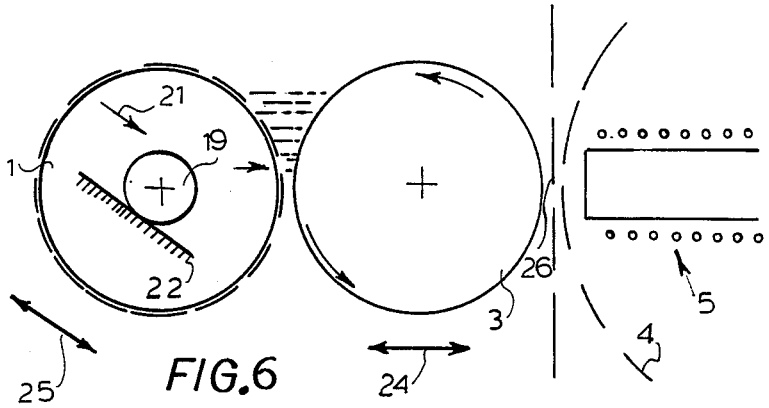

Another variant of this embodiment is shown in FIG. 6. Here, the pivot 19 of the roller 1 rests against an inclined plane 22 and the elastic force has here also a gravity-force component. Again, the applicator roller is movable in the direction of the double arrow 24, while the transfer roller is movable corresponding to the double arrow 25. Due only to the force of gravity, the transfer roller 1 is moved along the inclined plane 22, and thereby pressed against the applicator roller 3 and the latter is pressed magnetically against the application point 26 on the web 10.

It is self-understood that the invention does not limit itself to the illustrated examples; so, the supply of the medium to be applied can also take place from underneath, or at the circumference of the magnet roller 4 several various devices can be provided. As far as the material transfer to the transfer roller 1 is concerned, it is not absolutely required to provide a trough or container, since it is also possible to create a wedge-shaped space by means of a wall at the transfer roller 1, wherein the medium to be applied can be contained, i.e. between this wall and the surface of the transfer roller 1.

We claim:

1. A device for a dosed application of flowable medium on a web, comprising:

a transfer roller rotatable about an axis of rotation and in contact with a body of a flowable medium to be applied onto a surface of said web to be coated with said medium, said transfer roller having a structured surface determining the quantity of the medium to be applied;

an application roller having an elastic surface and being magnetically attracted to said transfer roller and being in contact with the surface of said transfer roller, said application roller receiving from said transfer roller the medium to be applied to said side to be coated of the web, so that said elastic surface is magnetically urged against said structured surface of the transfer roller, said application roller having a first axis which is free to move toward and away from said structured surface and said surface to be coated;

means defining a path for said web and a countersurface opposite said application roller; and means producing a magnetic field for attracting a body of said application roller and being swingably mounted on a second axis parallel to said first axis so that said body of the application roller, located between said spaced apart transfer roller and said means defining the path, is continuously urged against said side to be coated and is in a continuous contact with the surface of said transfer roller.

2. The device defined in claim 1 wherein said body of said application body is hollow.

3. The device defined in claim 1 wherein said transfer roller has magnetic means pivotable about a third axis corresponding to an axis of rotation of said transfer roller.

4. The device defined in claim 3, further comprising a plurality of magnetically attractible rollers in said body of said application roller.

5. The device defined in claim 4 wherein at least one of said plurality of rollers urges said application roller against said structured surface of said transfer roller.

6. The device defined in claim 1 wherein said structured surface of the transfer roller has at least one stripping wiper resting thereagainst.

7. The device defined in claim 1 wherein said means defining the path of the web is a further roller.

8. The device defined in claim 7 wherein said application roller is supported circumferentially by both said further roller and said transfer roller.

9. The device defined in claim 1 wherein said transfer roller is magnetizable.

10. The device defined in claim 1, further comprising guide means for guiding an axis of said transfer roller for movement in the direction of said application roller.

11. The device defined in claim 1 wherein a container is provided for said flowable medium and said container is located above the transfer roller, so that said transfer roller rests upon the application roller.

12. The device defined in claim 11 wherein said container is closed by two stripping wipers inclined toward the surface of said transfer roller, so that only the flowable material taken up by said structured surface leaves the container.

13. The device defined in claim 11 wherein said transfer roller is sealed against lateral walls of said container.

14. The device defined in claim 1, further comprising an axial friction drive, so that said application roller is driven by a peripheral drive and said axial peripheral drive.

15. A device for a dosed application of flowable medium on a web, comprising:

a transfer roller rotatable about an axis of rotation, said axis resting on generally horizontal plane guide means so that said transfer roller is radially movable, said transfer roller having a structured surface;

an application roller in contact with said transfer roller and receiving therefrom a flowable medium to be applied to a side to be coated of a web, said application roller having an elastic surface magnetically urged against said structured surface of the transfer roller, said application roller being radially movable with respect to said axis;

means defining a path of said web and a countersurface to said application roller, said means being arranged on a side of said web opposite said side to be coated; and means producing a magnetic field for attracting a body of said application roller and attracting said transfer roller against said application roller, so that said application roller is continuously urged against said side to be coated and is in a continuous contact with the surface of said radially movable transfer roller.

16. The device defined in claim 15 wherein said means defining the path of the web is a roller.

17. The device defined in claim 10 wherein said guide means is inclined.

18. A device for the dosed application of a flowable medium on a receiving surface of a web or a drum, comprising:

an application roller resting against a receiving surface to be coated with said flowable medium, said application roller having an elastic surface;

means for pressing said application roller against said receiving surface, said application roller being mounted without fixed axial bearings to enable it to move freely relative to said receiving surface and being magnetically retained in position against said receiving surface;

a transfer roller in contact with a body of said flowable medium and having a structure surface in the form of grid surface in pressing contact with said elastic surface and transferring said flowable medium to said elastic surface in a metered manner, whereby said application roller is subjected to a peripheral drive by entrainment with said receiving surface; and an axial friction drive operatively connected to said application roller in addition to said peripheral drive.

19. The device defined in claim 18, further comprising a wiper blade resting against said structure surface of said transfer roller for wiping that flowable medium therefrom.

* * * * *